United States Patent [19]

Polk et al.

[11] Patent Number: 4,759,066

[45] Date of Patent: Jul. 19, 1988

[54] SOUND SYSTEM WITH ISOLATION OF DIMENSIONAL SUB-SPEAKERS

[75] Inventors: Matthew S. Polk; Colin B. Campbell, both of Baltimore, Md.

[73] Assignee: Polk Investment Corporation, Wilmington, Del.

[21] Appl. No.: 54,480

[22] Filed: May 27, 1987

[51] Int. Cl.[4] ..... H04R 5/02

[52] U.S. Cl. ..... 381/24

[58] Field of Search ..... 381/1, 18, 19, 24, 27

[56] References Cited

U.S. PATENT DOCUMENTS

| | | | |
|---|---|---|---|
| 3,162,728 | 12/1964 | Pfister | 381/24 |
| 3,697,692 | 10/1972 | Hafler | 381/18 |
| 3,919,478 | 11/1975 | Schott | 381/18 |
| 4,132,859 | 1/1979 | Ranga | 381/18 |
| 4,382,157 | 5/1983 | Wert, Jr. | 381/24 |
| 4,443,889 | 4/1984 | Norgaard | 381/24 |
| 4,569,074 | 2/1986 | Polk | 381/24 |
| 4,594,729 | 6/1986 | Weingartner | 381/24 |

*Primary Examiner*—Forester W. Isen

*Attorney, Agent, or Firm*—Irell & Manella

[57] ABSTRACT

A loudspeaker system for reproducing stereophonic sound having an expanded acoustic image has left and right main speakers and left and right dimensional speakers. The main speakers are fed the right and left channel signals R and L and the dimensional speakers are fed the difference signals R - L and L - R. Inter-speaker cabling includes one or more transformers used to develop and couple the difference signals to the dimensional speakers, which serve as isolation means and also suppress the -R and -L components of the difference signals for low frequencies. The loudspeaker system is particularly suited for automobile installations where the main speakers are in front and the dimensional speakers in the rear of the automobile interior, or vice versa.

7 Claims, 2 Drawing Sheets

Fig. 1.
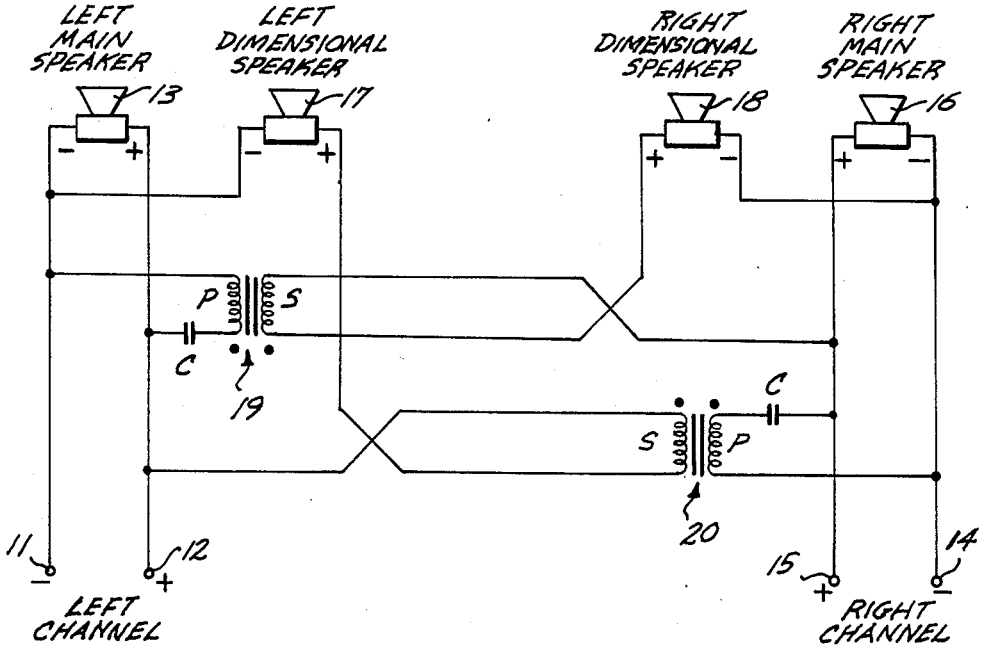
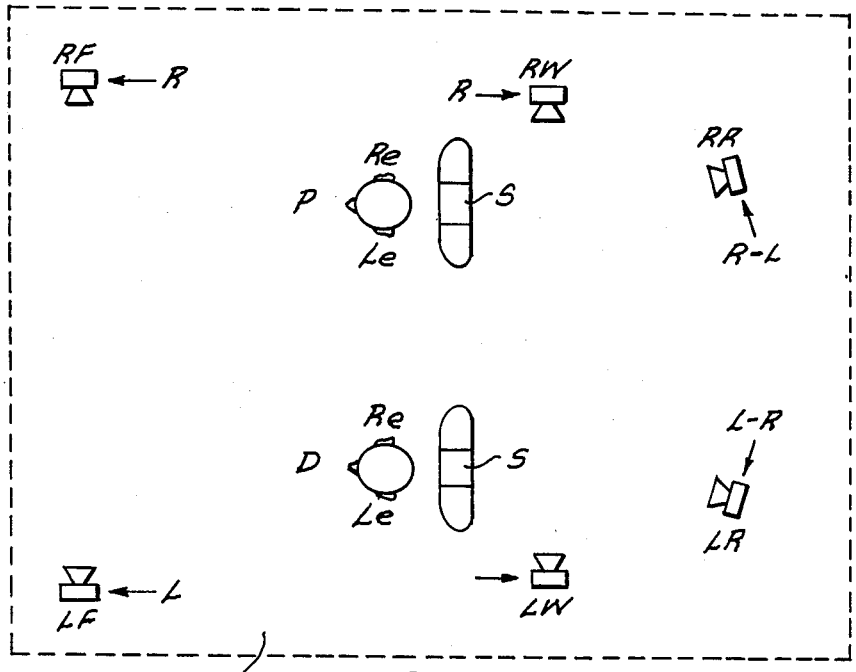
Fig. 3.

SOUND SYSTEM WITH ISOLATION OF DIMENSIONAL SUB-SPEAKERS

BACKGROUND OF THE INVENTION

The present invention relates to an improvement on the apparatus and methods described and claimed in U.S. Pat. No. 4,489,432 and in U.S. Pat. No. 4,638,505, which relate to arrangements for reproducing sound and obtaining an enhanced acoustic image. In accordance with one aspect of the present invention, it relates to reproducing sound and obtaining an enhanced acoustic image in the context of an automobile sterephonic sound reproduction system. One aspect of the method and apparatus described in U.S. Pat. No. 4,489,432, the disclosure of which is hereby incorporated by reference, is the requirement that a left minus right signal (L−R) be developed and fed to the left sub-speaker and that a right minus left signal (R−L) be developed and fed to the right sub-speaker. The application of these signals to the sub-speakers in combination with the other aspects of the invention produce an expanded acoustic image.

U.S. Pat. No. 4,638,505, the disclosure of which is also hereby incorporated by reference, represents an improvement to the basic system and method of U.S. Pat. No. 4,489,432, with specific reference to optimizing the low frequency response of such loudspeaker systems which have main and sub-speakers. Specifically, the required signals for the sub-speakers are derived in such a way that they will work in concert with the associated right or left main speaker at low frequencies regardless of the relationship of right to left channel stereo signals coming from the amplifier. Inter-speaker cabling is used for development of the R−L and L−R signals for application to the sub-speakers. The inter-speaker cabling includes impedance means such that above approximately 200 Hz the right and left sub speakers primarily receive, respectively, the R−L and L−R signals, and below approximately 200 Hz the right and left sub speakers primarily receive respectively, the R and L signals.

Regardless of placement, the addition to an automobile sound system of a pair of speakers producing only difference signals would add considerable ambience and reverberance to the automobile sound system. U.S. Pat. No. 3,697,692 to Hafler describes such a system for home use. However, if Hafler's system were adopted for use in an automobile the rear speakers would produce very little bass information since it is not normally present in the difference signal. Since most automobile sound systems rely on the rear speakers (which typically use the air volume of the automobile trunk), for most of the low frequency output, this would be a serious limitation.

U.S. Pat. No. 4,594,729 to Weingartner relates to an automobile sterephonic sound system in which a pair of rear speakers are provided and R−L and L−R signals applied thereto. In that arrangement differential amplifiers are apparently used to derive the difference signals. Various attenuators also appear to be employed for increasing the amount of the L portion in the L−R difference signal applied to the left rear speaker and the R portion in the R−L difference signal applied to the right rear speaker. This may be an attempt to deal with the lack of bass output from speakers fed only by difference signals, but it is at best complicated and expensive.

OBJECTS AND SUMMARY OF THE INVENTION

It is an object of the present invention to achieve the expanded acoustic image and realistic ambient field of the systems and methods of the earlier U.S. Pat. Nos. 4,489,432 and 4,638,505 in the context of an automobile sound system.

It is another object of the present invention to provide an improved technique and arrangement for deriving the R−L and L−R difference signals for sub-speakers (also referred to herein as "dimensional speakers") applicable not only to an automobile sound system but also to the systems and methods of the above mentioned two U.S. Patents.

Briefly, in accordance with one embodiment of the invention, an automobile sound system has at least a pair (left and right) of front speakers and a pair (left and right) of rear speakers. The right and left front speakers are respectively fed the right channel and left channel stereo signals. The left and right rear speakers, which serve as sub-speakers or dimensional speakers, are respectively fed the difference signals L−R and R−L. Alternatively, the present invention is equally applicable to an arrangement where the rear speakers are fed the right and left channel signals and the front speakers are fed the two respective difference signals. Moreover, the present invention relates to a novel and improved technique and arrangement for deriving the R−L and L−R difference signals which, although particularly advantageous in the context of an automobile sound system, is not restricted thereto. Specifically, inter-speaker cabling means is used to develop and couple the difference signals to the two dimensional speakers which includes transformer means. This solves the problem of most automobile stereo systems not being common ground amplifier systems since the transformer means provides isolation between connections to the right and left channel amplifier outputs. Moreover, the impedance of the transformer means is used to suppress the −L portion of the R−L difference signal and the −R portion of the L−R difference signal for frequencies below about 200 Hz. Other objects and advantages of the present invention will appear from the following detailed description taken in conjunction with the accompanying drawings.

BRIEF DESCRIPTION OF THE DRAWINGS

FIG. 1 is a circuit diagram of one embodiment of the present invention which utilizes two separate transformers in interspeaker cabling to develop difference signals for the dimensional sub-speakers.

FIG. 3 is a top plan view of placement of driver speakers and dimensional sub-speakers in a Maserati Biturbo automobile which has been found to work well in achieving an enhanced acoustic image and realistic ambient field of reproduced sound.

DETAILED DESCRIPTION

Figure 2:
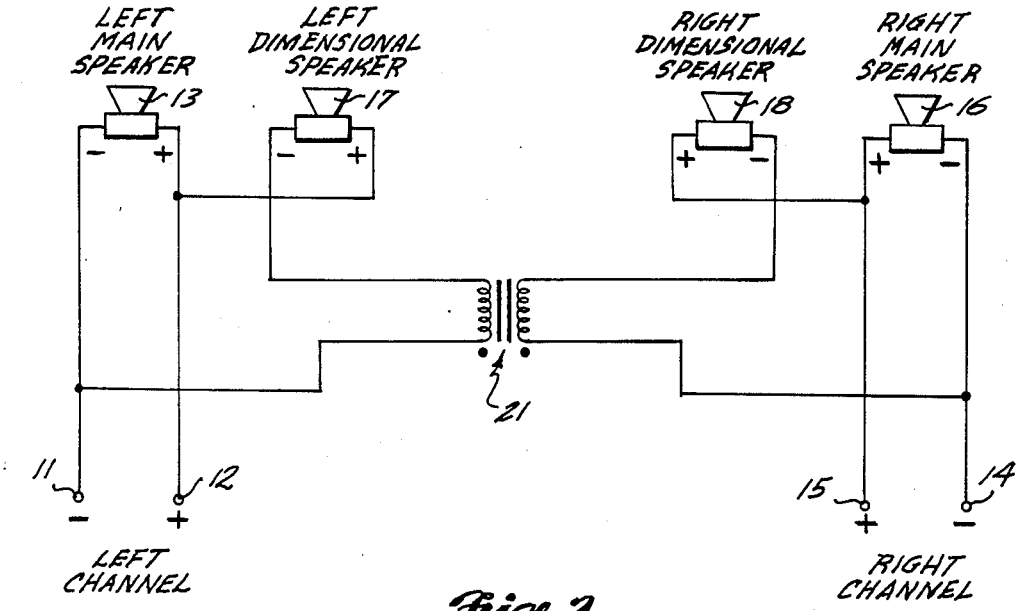
FIG. 2 is a circuit diagram of another embodiment of the present invention which utilizes only one transformer in the interspeaker cabling to develop the difference signals for the dimensional sub-speakers.

Turning now to FIG. 1, there is shown a circuit diagram of one embodiment of the present invention. A left channel stereo signal is present at terminals 11 and 12 and is connected directly to a left main speaker 13. Similarly, a right channel stereo signal is present at terminals 14 and 15 and is directly connected to a right main speaker 16. A left sub-speaker or dimensional speaker 17 and a right sub-speaker or dimensional speaker 18 are also provided. In the context of a home environment, the right main speaker and right dimensional speaker can be mounted in a common enclosure as can the left main speaker and left dimensional speaker, as disclosed as one of the embodiments in U.S. Pat. No. 4,638,505. In the context of an automobile environment, the main speakers are mounted in the front of the automobile, typically in the door kick panels or dashboard. The dimensional speakers are mounted in the rear of the automobile, typically in the rear deck or parcel shelf. It is also within the scope of the present invention to mount the main speakers in the rear of the automobile and the dimensional speakers in the front.

The embodiment of FIG. 1 includes two transformers 19 and 20 each having a primary winding P and a secondary winding S. The primary winding of transformer 19 is coupled through a capacitor C to the left channel input. The secondary winding of transformer 19 couples the left channel signal in the transformer primary in inverse phase to the right dimensional speaker 18. Similarly, the primary winding of transformer 20 is coupled through a capacitor C to the right channel input. The secondary winding of transformer 20 couples the right channel signal in the transformer primary in inverse phase to the left dimensional speaker 17. In accordance with a specific embodiment of the invention, the transformers 19 and 20 are 1:1, the inductance of the primary and secondary windings is 4.2 mH, the capacitors C have a value of 260 micofarads, and the dimensional speakers have an impedance of 6.2 ohms.

Most amplifiers in automobile stereo systems are of the bridged type, which means they are of a non-common-ground type. Use of the transformers 19 and 20 in the interspeaker cabling for development of the difference signals avoids problems because of the isolation provided by the transformers. In the arrangement of FIG. 1, the capacitors C allow current from a first channel to flow in the primary of one of the transformers which causes current flow in the secondary, thereby feeding this signal to the opposite channel dimensional driver. The signal from the second channel flows through the secondary of the transformer which induces a current in the primary. At mid and high frequencies this current is passed by the capacitor and flows unimpeded through the first channel output section which is assumed to be a very low impedance. In effect, the current from the second channel appears to pass with very little resistance through the transformer secondary directly to the dimensional speaker with the first channel current being added to it, in inverse phase, in the process. However, at low frequencies the inductance of the transformer windings is not great enough to promote effective coupling of the primary and secondary so that the second channel current flows directly through the transformer without having the first channel added to it. This has the effect of suppressing the −L and −R portions of the difference signals for low frequencies, below about 200 Hz. The values of the capacitors C are chosen to complement the inductance value of the transformer so as to prevent the impedance seen by the first channel from being near zero at DC due to the connection of the transformer primary across the output.

Referring to FIG. 2, there is shown another embodiment of the invention in which like components to the embodiment of FIG. 1 have been given identical reference numbers to those used in FIG. 1. The arrangement of FIG. 2 only utilizes one transformer 21, with one of the windings of the transformer coupling one of the right and left channel inputs to one of the dimensional speakers and the other of the right and left channel inputs being coupled through the other transformer winding to the other dimensional speaker. In the arrangement of FIG. 2 the finite value of the inductance in the transformer windings effectively limits the −R and −L portions of the difference signals applied to the dimensional speakers for low frequencies, below about 200 Hz. For higher frequencies the R−L and L−R difference signals are properly coupled to the dimensional speakers. In the embodiment of FIG. 2, the transformer 21 has 1:1 windings, each having an inductance of 8.4 mH, and the impedance of each of the dimensional speakers is 3.1 ohms.

Figure 2A:
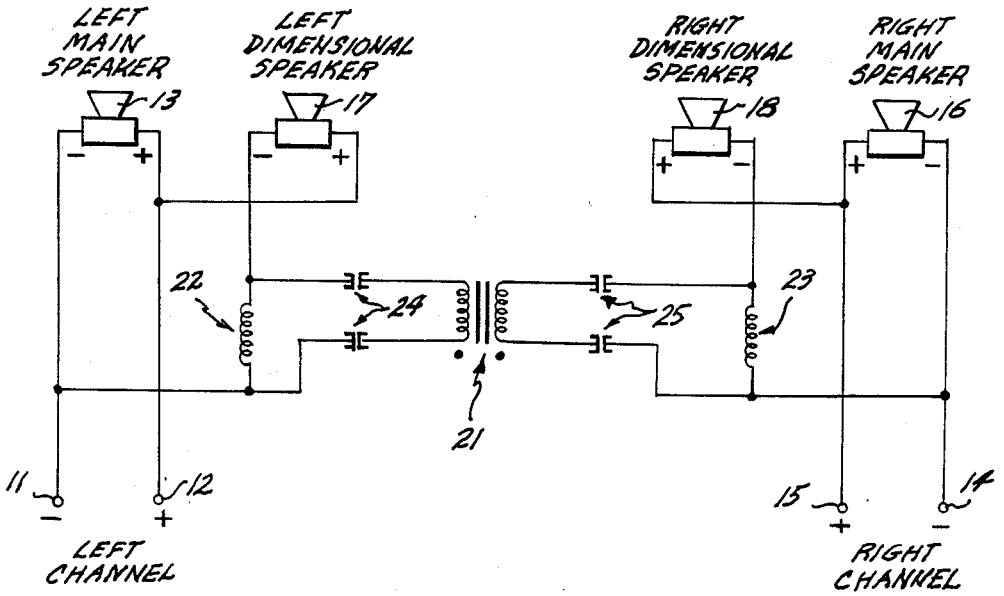
FIG. 2*a* is another embodiment of the present invention wherein two inductors are added to the circuit of FIG. 2 such that the single transformer in the interspeaker cabling utilized to develop the difference signals for the dimensional sub-speakers may be removed from the circuit without affecting the operation of the system when used with common-ground type amplifiers or added as an accessory for use with non-common-ground type amplifiers.

Referring to FIG. 2*a*, there is shown another embodiment of the invention in which like components to the embodiments of FIG. 1 and FIG. 2 have been given identical reference numbers to those used in FIG. 1 and FIG. 2. The arrangement of FIG. 2*a* operates in the same fashion as the arrangement of FIG. 2 in utilizing a single transformer to develop a difference signal to be fed to the dimensional speakers while employing the finite inductance of the transformer windings to limit the −R and −L portions of the difference signal applied to the dimensional speakers at low frequencies. The arrangement of FIG. 2*a* employs additional inductors 22 and 23 in parallel to the transformer 21 windings which provide an additional path for current flowing through the dimensional speakers at low frequencies. Values for the inductors 22 and 23 and inductance value of the transformer 21 windings are chosen such that for mid and higher frequencies the R−L and L−R difference signals are properly coupled to the dimensional speakers and such that the −R and −L portions of the difference signal applied to the dimensional speakers are effectively limited at low frequencies, below about 200 Hz. Proper choice of values also permits the transformer 21 to be removed from the circuit and replaced with straight cabling without affecting the operation of the system when used with common-ground type amplifiers. This is illustrated by the connecting jacks 24 and 25 shown in FIG. 2*a*. The transformer 21 may then be added to the system as an accessory if use with non-common-ground type amplifiers is contemplated. Additionally, a suitable construction method may be chosen for inductors 22 and 23 such that they have a high current carrying capacity before saturation occurs. This allows the system to operate with low harmonic distortion at high levels while using a lighter, less expensive construction for transformer 21. In one embodiment of FIG. 2*a* inductors 22 and 23 are of the air core type with inductance of 16.8 mH, the transformer 21 has 1:1 windings each having an inductance of 16.8 mH and the impedance of each of the dimensional speakers is 3.1 ohms. As a general rule the values of inductors 22 and 23 in FIG. 2*a* and the windings of transformer 21 will be the same and equal in value to twice the inductance of the windings of transformer 21 shown in FIG. 2, all other values being held constant.

FIG. 3 shows an arrangement which has been utilized in a Maserati Biturbo automobile and found to produce good results. The automobile interior 26 has seats S for a driver D and a passenger P. The driver and passenger each have right ears Re and left ears Le. Left front LF and right front RF speakers are provided and respectively fed the left L and right R channel stereo signals. In the actual embodiment tested the automobile also had right and left woofers Rw and LW as shown in FIG. 3 which were fed the right channel and left channel signals R and L, respectively. Mounted in the rear of the automobile interior are the right rear RR and left rear LR dimensional speakers, which are fed the R−L and L−R difference signals, respectively. The interspeaker cabling means connecting the various speakers is not shown in FIG. 3, but is in accordance with one or the other of the arrangements shown in FIG. 1 and FIG. 2. The actual distances from the various speakers to the ears of the passenger were measured, and are given in the following table:

| | |
|---|---|
| Re-LF = 59.5 inches | Le-LF = 53.8 inches |
| Re-RF = 36.9 inches | Le-RF = 39.4 inches |
| Re-LR = 56.5 inches | Le-LR = 51.2 inches |
| Re-RR = 39.0 inches | Le-RR = 40.8 inches |
| Re-Lw = 49.8 inches | Le-LW = 43.0 inches |
| Re-RW = 21.5 inches | Le-RW = 25.0 inches |

It can be seen that the distances from the rear deck mounted speakers to the front passenger's ears are nearly the same as those from front kick panel mounted speakers. The relationship between these dimensions seems to remain fairly constant from automobile to automobile. Using this configuration the effect produced is that of a very wide stereo image with left and right images of equal strength for both front seat locations. Sound images frequently seem to be outside of the automobile even with the windows up.

While the present invention has been described with reference to specific preferred embodiments, it should be clearly understood that various modifications and changes thereto are within the skill of one working in this art, without departing from the true spirit and scope of the invention.

We claim:

1. A loudspeaker system for a stereophonic sound reproduction system having a right channel output signal R with plus and minus output terminals and a left channel output signal L with plus and minus output terminals, said loudspeaker system comprising a right main speaker and a right dimensional speaker, a left main speaker and a left dimensional speaker, interspeaker cabling means for applying signal R to said right main speaker and a signal R−L to said right dimensional speaker, and signal L to said left main speaker and a signal L−R to said left dimensional speaker, said interspeaker cabling means including transformer impedance means having values selected to substantially attenuate the −L portion of the R−L signal applied to the right dimensional speaker and the −R portion of the L−R signal applied to the left dimensional speaker for low signal frequencies.

2. A loudspeaker system in accordance with claim 1 wherein said transformer impedance means comprises a first transformer having its primary winding connected through a first capacitor to the right channel output signal R and its secondary winding inversely coupled to the left dimensional speaker and a second transformer having its primary winding connected through a second capacitor to the left channel output signal L and its secondary winding inversely coupled to the right dimensional speaker.

3. A loudspeaker system in accordance with claim 1 wherein said transformer impedance means comprises a transformer having primary and secondary windings, with one of said primary and secondary windings coupling the minus terminal of one of said right and left channel output signals to the minus terminal of one of said right and left dimensional speakers, and the other of said primary and secondary windings coupling the minus terminal of the other of said right and left channel output signals to the minus terminal of the other of said right and left dimensional speakers.

4. A loudspeaker system in accordance with any one of claims 1 through 3 wherein the main speakers and dimensional speakers are mounted in the interior of an automobile, with the main speakers mounted in the front of the interior and the dimensional speakers mounted in the rear of the interior.

5. A loudspeaker system in accordance with any one of claims 1 through 3 wherein the main speakers and dimensional speakers are mounted in the interior of an automobile, with the main speakers mounted in the rear of the interior and the dimensional speakers mounted in the front of the interior.

6. A loudspeaker system for a stereophonic sound reproduction system having a right channel output signal R with plus and minus output terminals and a left channel output signal L with plus and minus output terminals, said loudspeaker system comprising a right main speaker and a right dimensional speaker, a left main speaker and a left dimensional speaker, interspeaker cabling means for applying signal R to said right main speaker and a signal R−L to said right dimensional speaker, and signal L to said left main speaker and a signal L−R to said left dimensional speaker, said interspeaker cabling means consisting of direct connections of the plus terminals of the respective dimensional speakers to the respective main speakers, and first and second inductors connecting the minus terminals of the respective dimensional speakers to the minus terminals of the respective main speakers with the first and second inductors being a.c. coupled with each other, whereby the first and second inductors have values selected to substantially attenuate the −L portion of the R−L signal applied to the right dimensional speaker and the −R portion of the L−R signal applied to the left dimensional speaker for low signal frequencies.

7. A loudspeaker system in accordance with claim 6 additionally including a transformer having primary and secondary windings, said transformer serving to couple the first and second inductors, the primary and secondary windings respectively being connected in parallel with said first and second inductors so as to isolate connections between the signals R and L, with the values of the first and second inductor and the primary and secondary windings being selected to substantially attenuate the −L portion of the R−L signal applied to the right dimensional speaker and the −R portion of the L−R signal applied to the left dimensional speaker for low signal frequencies.

* * * * *